US008226386B2

(12) United States Patent
Cifuentes

(10) Patent No.: US 8,226,386 B2
(45) Date of Patent: Jul. 24, 2012

(54) DEEP FORCE PUMP FOR OIL WELLS

(76) Inventor: Carlos Alberto Cifuentes, Neuquen State (AR)

( * ) Notice: Subject to any disclaimer, the term of this patent is extended or adjusted under 35 U.S.C. 154(b) by 650 days.

(21) Appl. No.: 12/412,616

(22) Filed: Mar. 27, 2009

(65) Prior Publication Data

US 2010/0092314 A1 Apr. 15, 2010

(30) Foreign Application Priority Data

Oct. 9, 2008 (AR) ..... P20080104419

(51) Int. Cl.
*F04B 39/10* (2006.01)
*F04B 39/12* (2006.01)

(52) U.S. Cl. ..... 417/545; 417/518; 417/571

(58) Field of Classification Search ..... 417/56–60, 417/415, 443, 518, 545–554, 571, 904
See application file for complete search history.

(56) References Cited

U.S. PATENT DOCUMENTS

| | | | | |
|---|---|---|---|---|
| 2,797,642 | A * | 7/1957 | Bloudoff | 166/54.1 |
| 2,801,595 | A * | 8/1957 | Knabe et al. | 417/449 |
| 4,320,799 | A | 3/1982 | Gilbertson | |
| 4,421,463 | A | 12/1983 | Lee | |
| 4,516,917 | A | 5/1985 | Canalizo | |
| 4,534,715 | A * | 8/1985 | Jones | 417/456 |
| 4,551,075 | A | 11/1985 | Canalizo | |
| 4,596,515 | A | 6/1986 | Simon et al. | |
| 4,738,599 | A | 4/1988 | Shilling | |
| 4,753,577 | A | 6/1988 | Black et al. | |
| 5,845,709 | A | 12/1998 | Mack et al. | |

FOREIGN PATENT DOCUMENTS

| | | |
|---|---|---|
| CA | 2211673 | 1/1998 |
| GB | 776905 | 6/1957 |
| GB | 778489 | 7/1957 |
| GB | 837847 | 6/1960 |
| GB | 1134135 | 11/1968 |

* cited by examiner

*Primary Examiner* — Joseph L Williams
*Assistant Examiner* — Nathaniel Lee
(74) *Attorney, Agent, or Firm* — Defillo & Associates, Inc; Evelyn A. Defilló

(57) ABSTRACT

Once the production route by the tubing has been selected, the stem travels through the inside of a guide whose upper end has a diameter adjusted to that of a rod which develops, increasing until it is connected to a barrel. The upper part of a anchor is arranged in the lower part of the barrel. The lower part of the anchor is connected to a nipple fixed to a transfer box. The fluid passage from an admission valve to the barrel in the upward stroke and the emptying of the barrel in the downward stroke is linked at least with a connector disposed between a basket and the transfer box. The basket houses the ball and the seat of at least one production valve arranged together with at least one connector in a carrier body retained between the transfer box on the top and a cage at the bottom and fitted to a conduit. The admission valve is housed inside the cage and it is provided with a ball that releases or obstructs the fluid passage. Such passage provides a seating seal of the ball linked to a connector body that tightens the admission valve which provides a threaded torque in its lower end. A relief valve is housed in the piston cage and its opening releases the excess of pressure generated between the lower end of the guide and the upper end of the piston and towards the inside of this one.

15 Claims, 10 Drawing Sheets

DEEP FORCE PUMP FOR OIL WELLS

BACKGROUND (1) Field of the Invention

This invention consists of a deep force pump for oil wells.

In order to get a better understanding of this invention so that it can be put into practice with ease, a detailed description will be given in the following paragraphs about the best way to carry out the invention, making reference in the description to the attached drawings, the whole with character of purely demonstrative example but not restrictive to the invention. Its components can be selected among several equivalents without leaving aside the principles of the invention established in this documentation.

(2) Prior Art

Mechanisms being used at present for fluid extraction in oil wells have been compared, particularly, the reciprocating type pumps that work in depth. Document CA 1172908 is studied which refers to a submersible reciprocating pump mounted on a tubing connected to the surface and wherein there is a rod. A hydraulic unit operates the hydraulic cylinder in a cycle which upward movement is carried out by hydraulic power and which downward movement is by gravity.

Patent CA 1203749 protects a reciprocating pump where the movement is given by the passage of hydraulic fluid to act over the piston moving it in one direction, acting in the opposite direction due to the hydrostatic pressure exerted.

Document CA 1209464 has also been also studied where there is reference to a downhole well pump which includes a fluid conduit connected to its upper end by a remotely releasable connector which makes it possible to retrieve the pump.

Document CA 2194257 refers to a pumping system which uses a submersible pump having a means to re-circulate the liquid and a production pump where both share the fluid intake.

Document CA 2211673 refers to a pumping system which includes a tubing that is part of a productive circuit to obtain a fluid.

British patent GB 1134135 refers to the installation of a deep well pump where a pump extracts liquid from the well and makes it pass through a sand filter and it is then recirculated under the control of a valve via the annular space between the oscillating well tubing and the pipe jacket to the lower end of the tube to mix the liquid with the sand of the well.

Patent GB 776905 has been localized and it refers to improvements in the mechanism of a well pump hydraulic drive where the well pump has a hydraulic drive mechanism which comprises a cylinder and a piston connected to the well rods mounted on a tripod arranged on a base. Said piston carries an actuating bar for both pilot valves placed at each end of the piston stroke.

Document GB 778489 is studied and it refers to devices for deep well pumping where motors and pumps are of the outwardly-sliding vane type. The unit is suspended in a well and liquid is sucked up through a strainer passing into a manifold where fluids mix and pass to the top of the well by way of tubing from where it is pumped to the surface. At the same time, the fluid enters at each end of the rotor by way of by-passes done in the motor cylinder and channels of the bearings to equalize the pressures on the ends of the rotors.

Patent GB 837847 is also studied and it refers to a deep well pump, which structure for anchoring pumps in a well comprises a tubing extension, secured on to the end of a tubing string which includes a cross-over connection secured to a seating nipple.

Likewise the U.S. Pat. No. 4,421,463 is also studied. It is related to a pump for use in a well which includes a casing, a coaxially aligned tubing within the casing for transporting fluid, and the fluid that fills the space between the tubing and the casing. Several holes are formed in the casing to permit communication between the casing and lower portion of the tubing. The pump alternately applies pressure and vacuum to the fluid between the casing and the tubing thereby moving the bucket up and down and pumping fluid up the tubing.

Likewise U.S. Pat. No. 4,596,515 is also studied and it refers to a pump for oil wells able to recover liquid from a well defined area by a casing that extends downwardly into the well.

Likewise U.S. Pat. No. 4,738,599 is localized. It refers to a well pump having inner and outer barrels and a hydraulic fluid line which extends downwardly through the casing and outside the tubing string.

Document U.S. Pat. No. 4,753,577 is localized and it protects a jet pump system which includes a pump body having a nozzle carrier, a pump housing and a cross-over housing connected in axially alignment.

SUMMARY OF THE INVENTION

Oil extraction is performed in wells whose mantles are located at different depths and contain fluids of several densities. This extraction keeps basically the same structure which is a pumping device composed by two units, one of them installed on the surface and the other in the well at the mantle level which is being exploited.

The unit located on the surface is the typical "horsehead pump" which comprises a walking beam with a number of rods connected together which are related to the depth unit or pump itself.

When the pumping unit (horsehead) is set into motion, it moves the rods in an upward and downward rhythmical movement. At the same time, as the last of the rods is connected to the pump piston, its driving permits the fluid to get inside the tubing or production conduct which starts filling until it reaches the surface.

If we take into consideration that it is not unusual for a well to exceed 1500 meters deep, the pumping unit, rods, reducing box and the pump itself must be designed so as to work holding a column (for example) 1500 meters high, a sufficient number of rods to reach this depth and the pump piston.

The invention described below, permits to work in the conventional manner of production, through the tubing, or alternatively with the casing, that is to say, the conduit that comprises the tubing in its interior and separates it from the well walls but, in any of the two cases, avoiding the need to support the weight of the fluid column.

That is the reason why the pumping unit will only have the amount of rods necessary to reach the exploitation depth plus an additional, represented by an overweight that provides the downward stroke impelling the fluid.

This enables to reduce the size of the units, the infrastructure for its transportation and maintenance, the volume of fuel and the environmental pollution.

As the user is the one who will determine the production route, it is necessary to have the appropriate means to guide the fluid towards the tubing when selecting the tubing.

As regards the pump, this can be installed beneath or among the perforations or even above these, using different elements to help and improve the performance such as the tubing anchors, the rods centralizers, filters for solids, gas anchors, etc.

However, if the user decides to utilize the casing as production route, the pump must unavoidably be installed above the producer perforations, isolating them from the upper part of the casing which will be used for the production.

For this option, the casing separation in two parts is performed using a commercially available packer.

It is the scope of this document to provide this tool by means of which the fluid load over the piston can be relieved, every time that this load is transferred by the pumping rods to the individual pumping machine or AIB as it is called in the oil environment, so as to reduce the load and the resulting effort of the AIB as well as its engine effort.

The essential difference between this invention and that which is of application in the prior art is that what is being revealed in this documentation corresponds to an arrangement which allows choosing the passage of fluid towards one of the production routes.

In effect, while in the embodiments of the prior art the fluid is induced only along the tubing, in this embodiment the fluid is, according to the user's criteria, induced along said tubing or otherwise along the casing.

It is then the purpose of this invention to obtain a pump which provides an appropriate means to work alternatively above the perforations of the casing for which a packer is used, being the packer function to isolate the perforations of the rest of the casing. In order to do this, the packer is fixed to the casing, above the perforations, thus allowing the anchorage of the pump in its upper part.

In a conventional deep mechanical pump, the fluid produced in the upward stroke of the piston is raised above this in such a manner that the weight of oil equivalent to the area of the piston selected multiplied by the height of the column measured from the depth where the pump is up to the wellhead, falls on said piston.

This knowledge determines that if it is possible to get rid of the weight that said column represents, the equipment necessary for pumping can use less power, and consequently, have less consumption.

The invention being described in this documentation consists of a pump which, instead of raising the fluid, as it is usual in the pumps referred to in the prior art, impels it downwardly where the production valves or ejector valves are located.

In this manner, upon avoiding the fluid weight to be applied onto the piston from where it is transferred by the rods towards the individual pumping machine, not only the load supported by said piston is relieved, but also the load transmitted to the AIB.

BRIEF DESCRIPTION OF THE DRAWINGS

In order to achieve a better understanding of the invention which protection is requested, several figures have been attached herein, where its components and aspects have been represented.

DETAILED DESCRIPTION OF THE PREFERRED EMBODIMENT(S)

Figure 1:
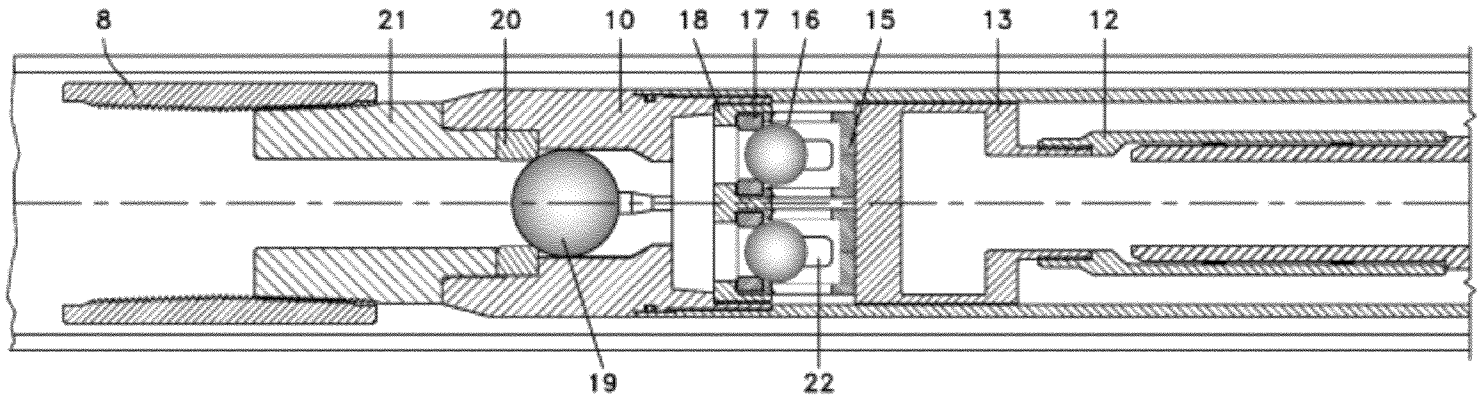
FIG. 1 schematizes a cut side view where the casing, the tubing and the several components part of this invention can be observed in the alternative of production by tubing. The basket to carry valves is shown in this Figure.
Figure 1:
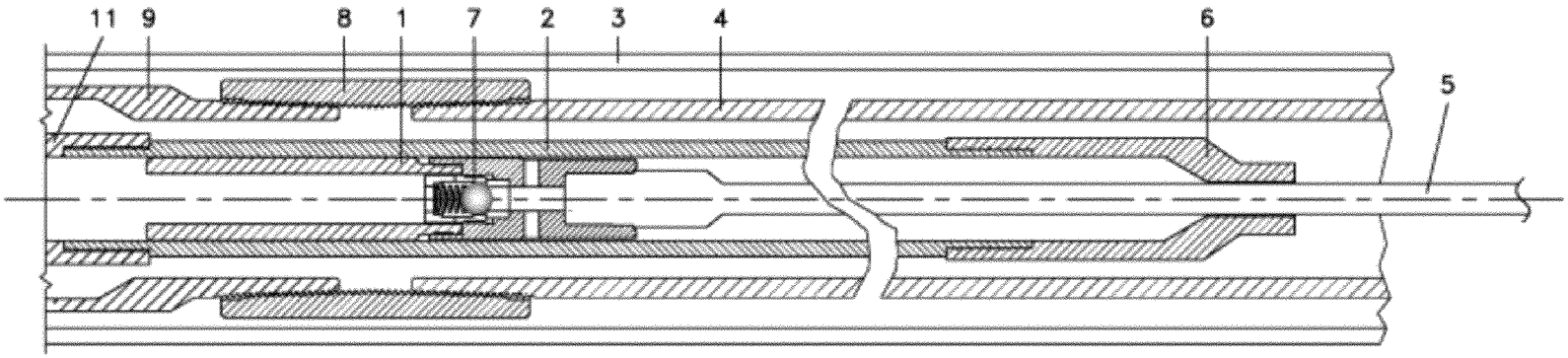
Figure 2:
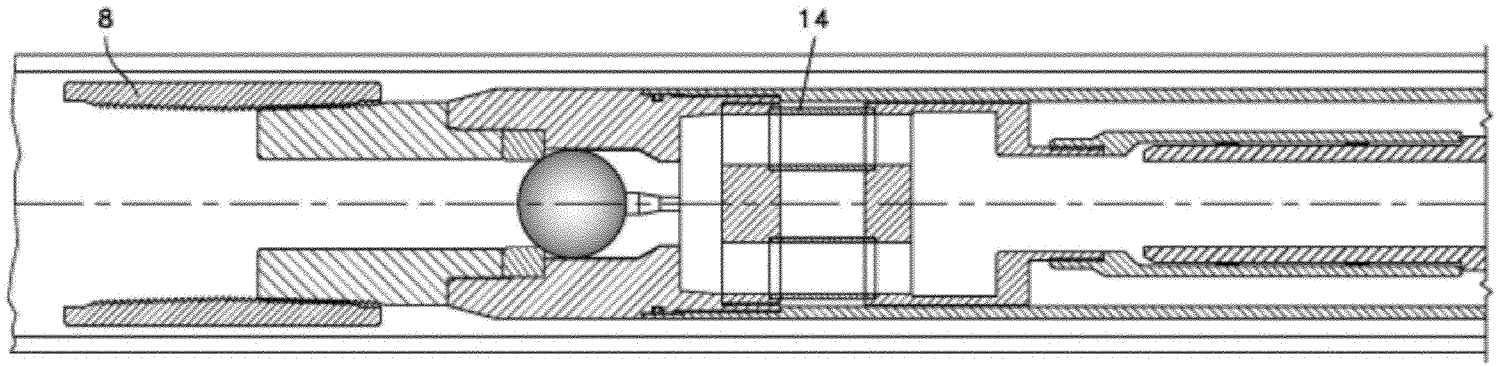
FIG. 2 schematizes a similar view to the previous one where the cut is greater, and the connectors can be observed.
Figure 2:
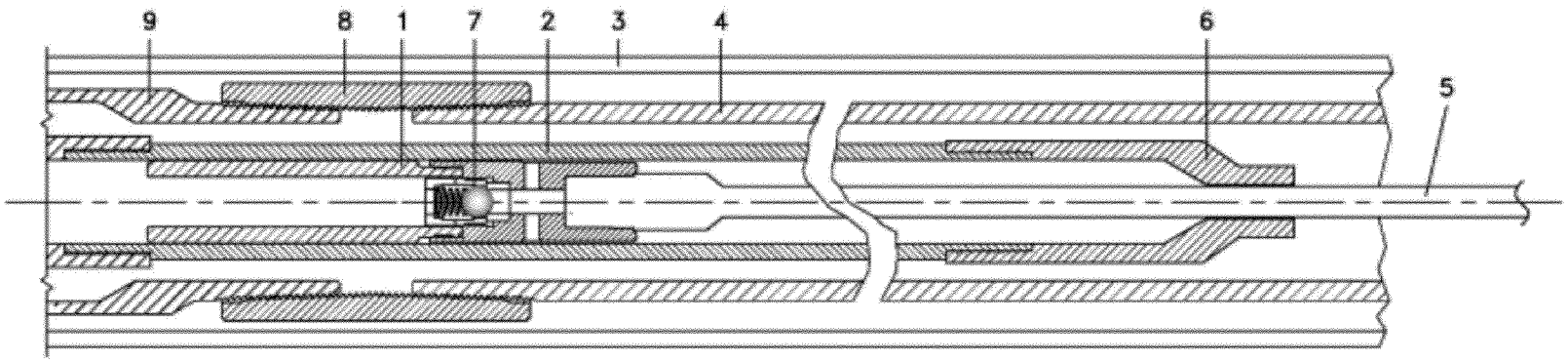
Figure 3:
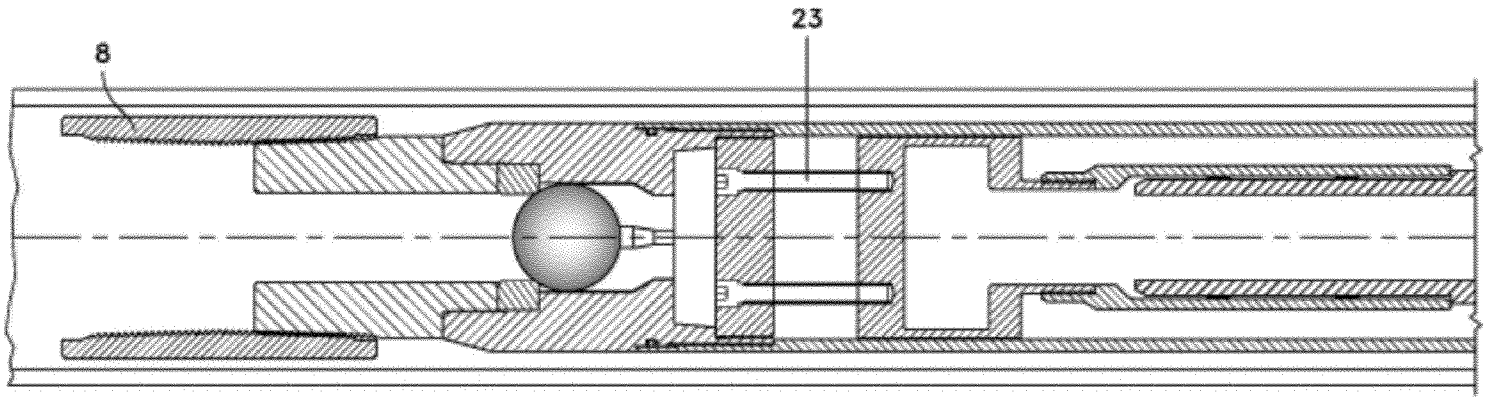
FIG. 3 schematizes a similar view to the previous one wherein the cut is greater so that the bolts can be observed.
Figure 3:
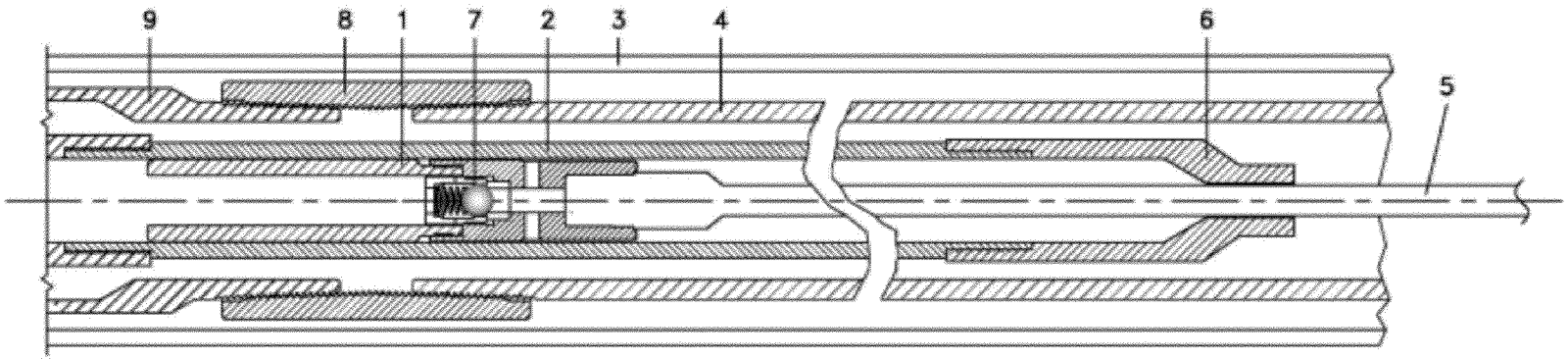
Figure 4A:
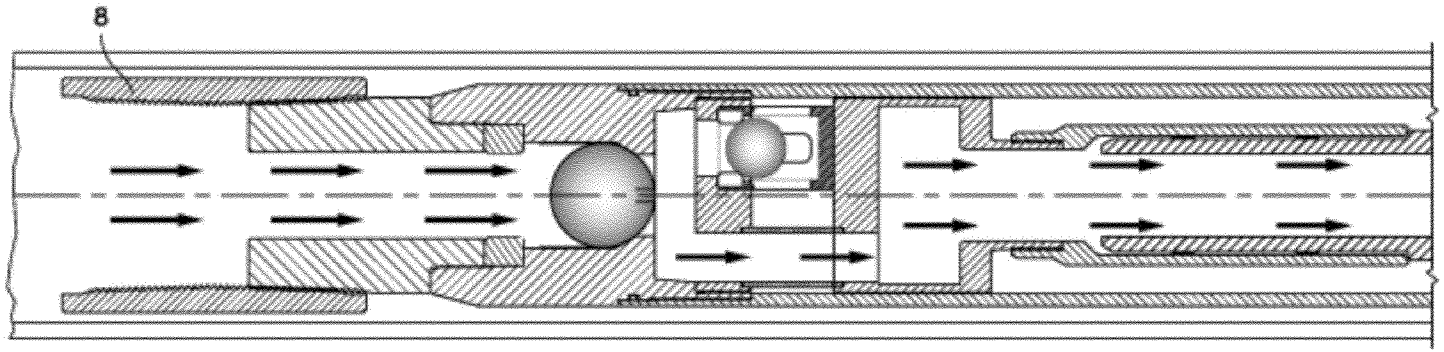
FIG. 4*a* schematizes a cut side view with the position of the several components shown in the upward stroke of the piston of the pump, while FIG. 4*b* schematizes the downward stroke.
Figure 4A:
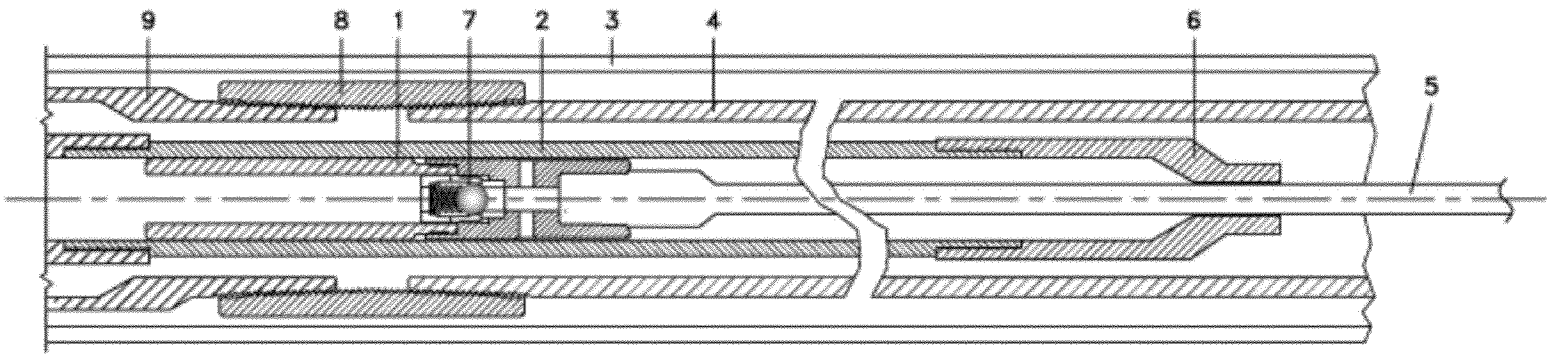
Figure 4B:
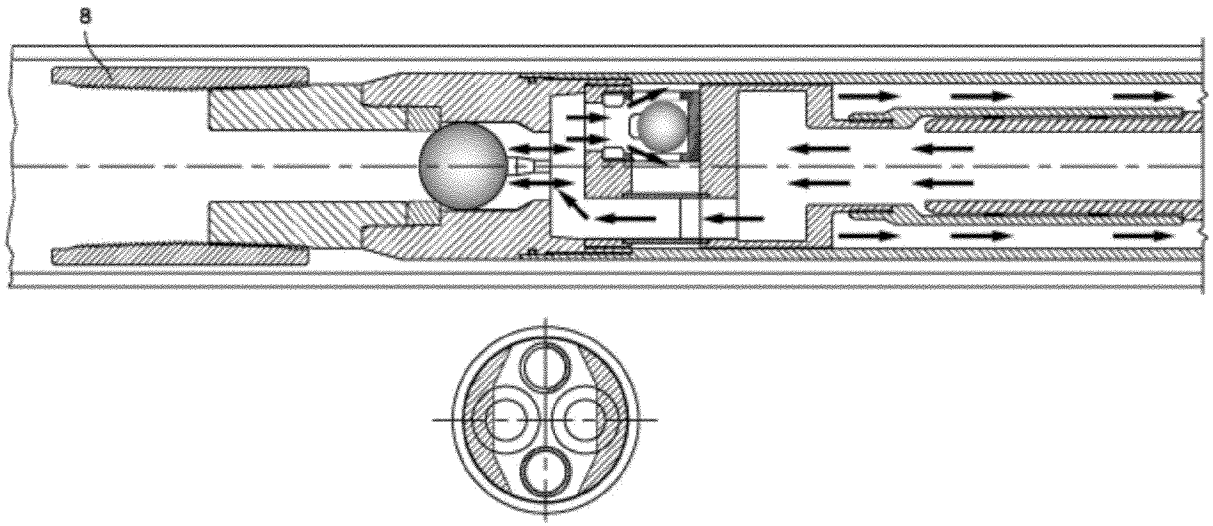
In FIG. 4*b* the enlarged detail exemplifies the production area.
Figure 4B:
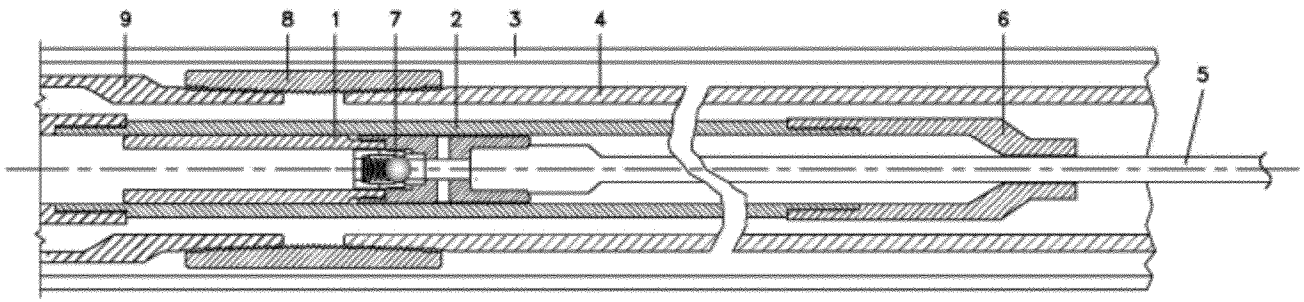
Figure 5:
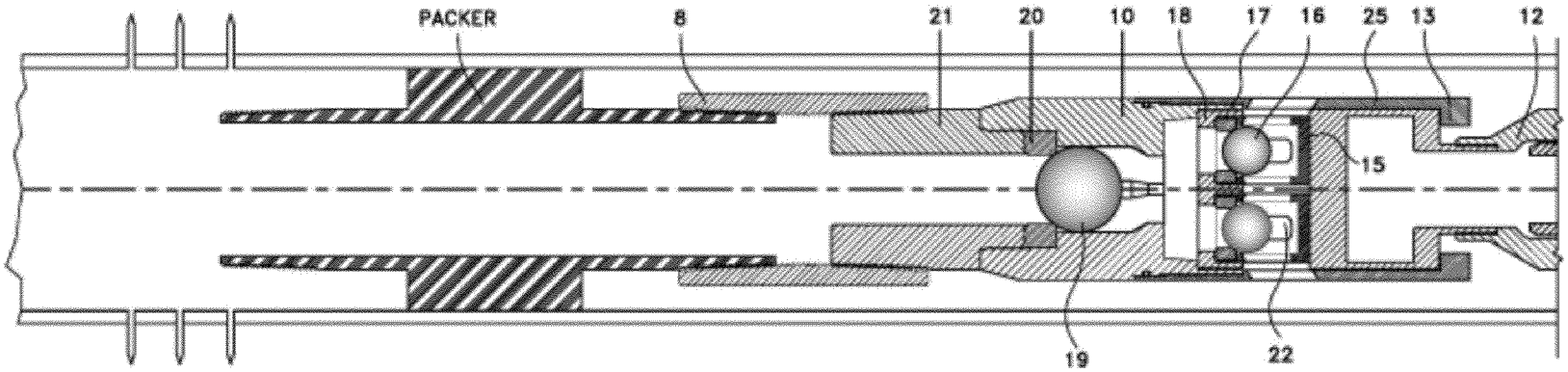
FIG. 5 schematizes a cut side view where the casing, the tubing and the several components part of the invention proposed can be observed in the alternative of production by casing. The basket to carry valves is also shown.
Figure 5:
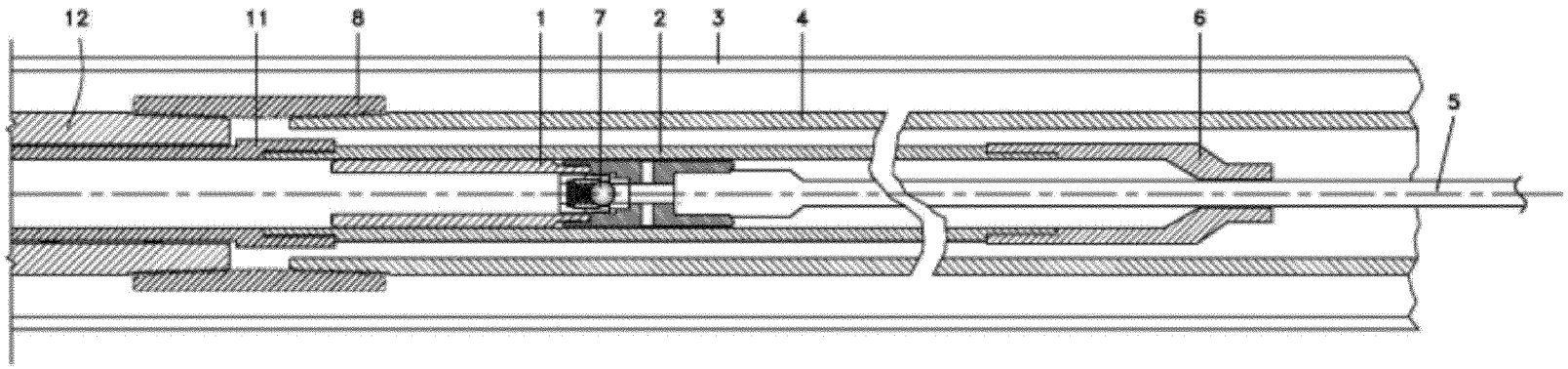
Figure 6:
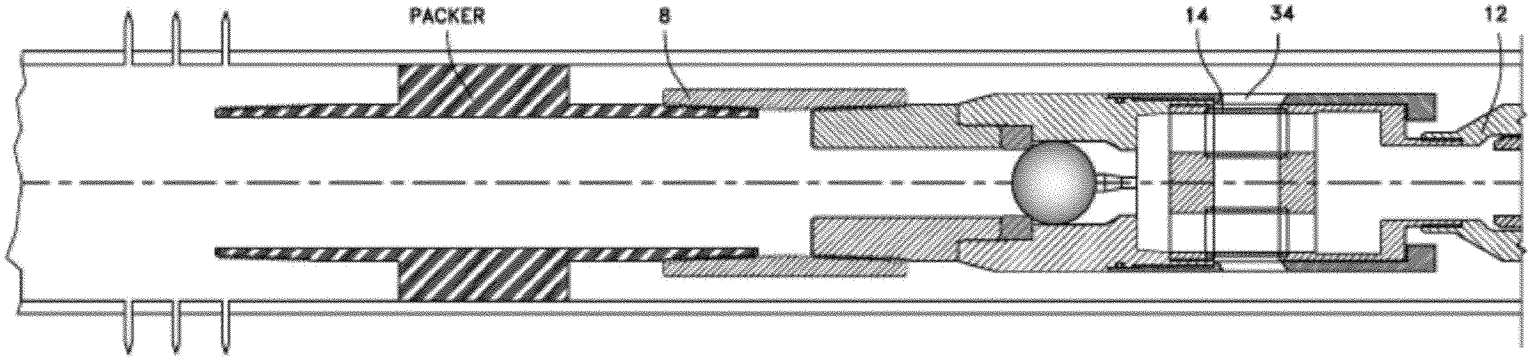
FIG. 6 schematizes a similar view to the previous one where the cut is greater and the connectors can be observed.
Figure 6:
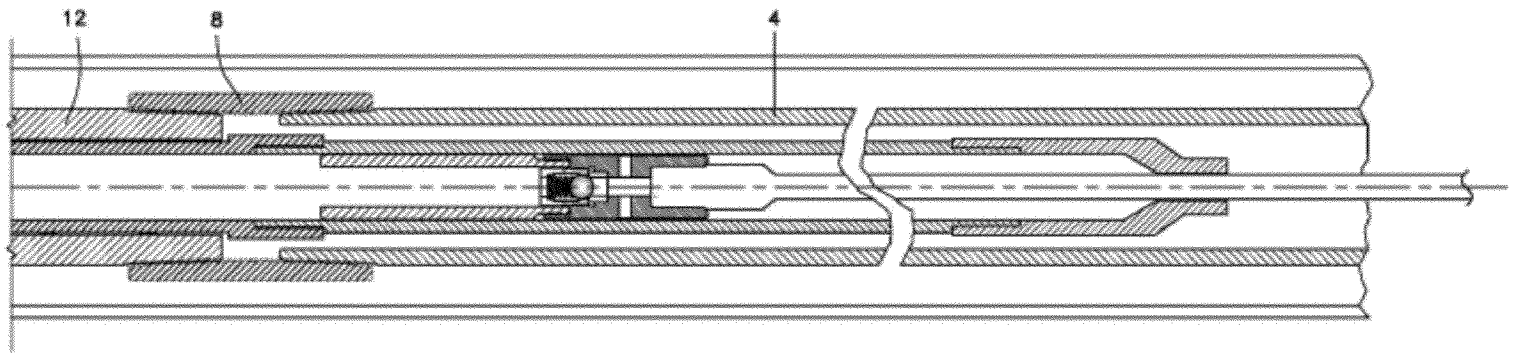
Figure 7:
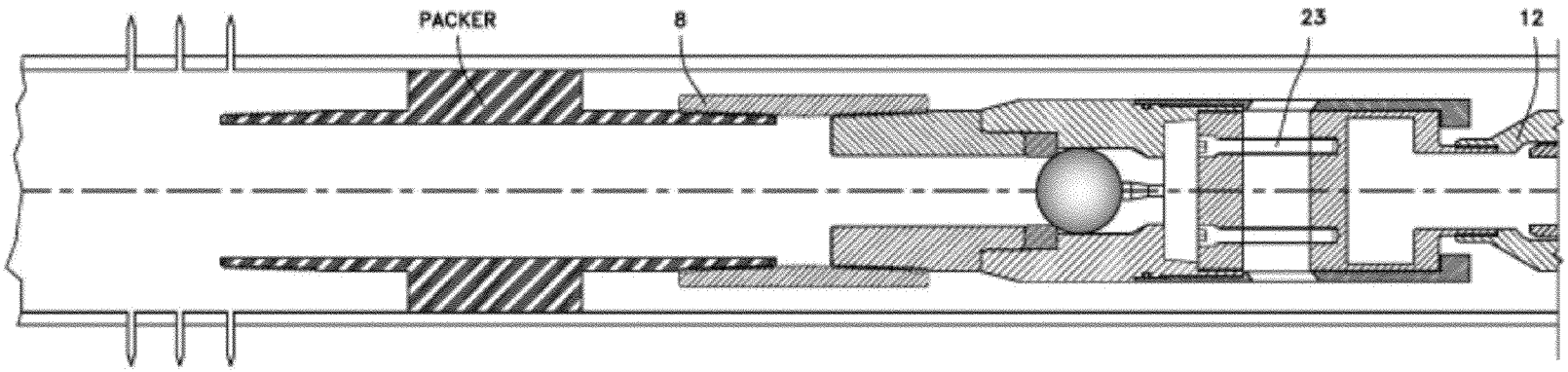
FIG. 7 schematizes a similar view to the previous one in which the cut is greater so that the bolts can be observed.
Figure 7:
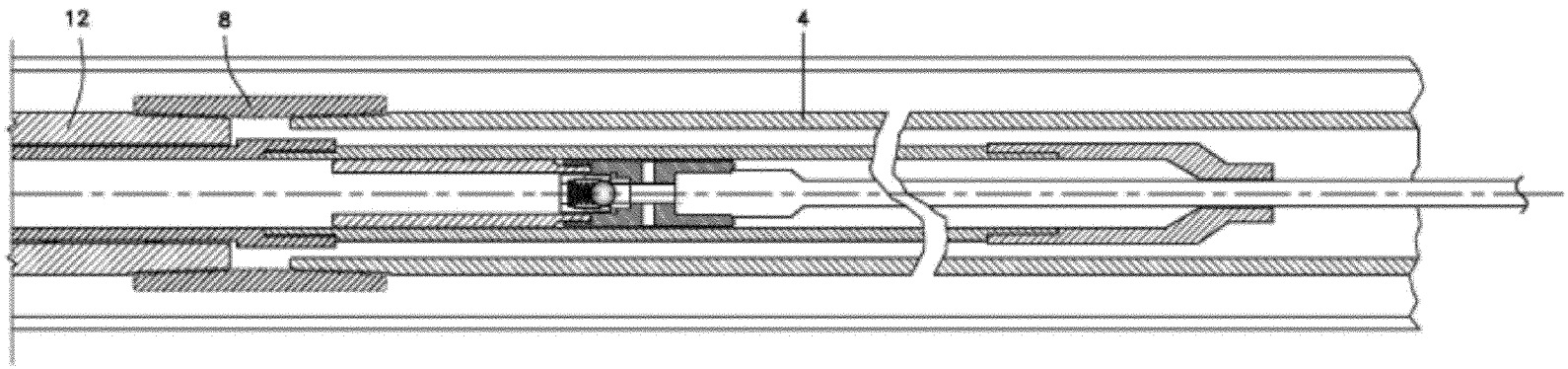
Figure 8A:
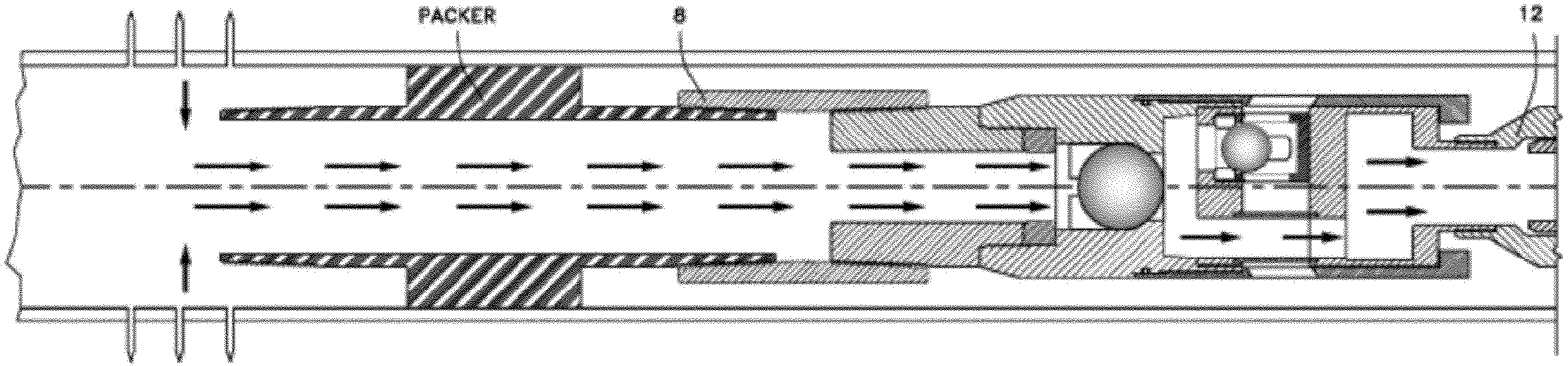
FIG. 8*a* schematizes a cut side view where the position of the several components is shown in the upward stroke of the piston of the pump, while FIG. 8*b* schematizes the downward stroke.
Figure 8A:
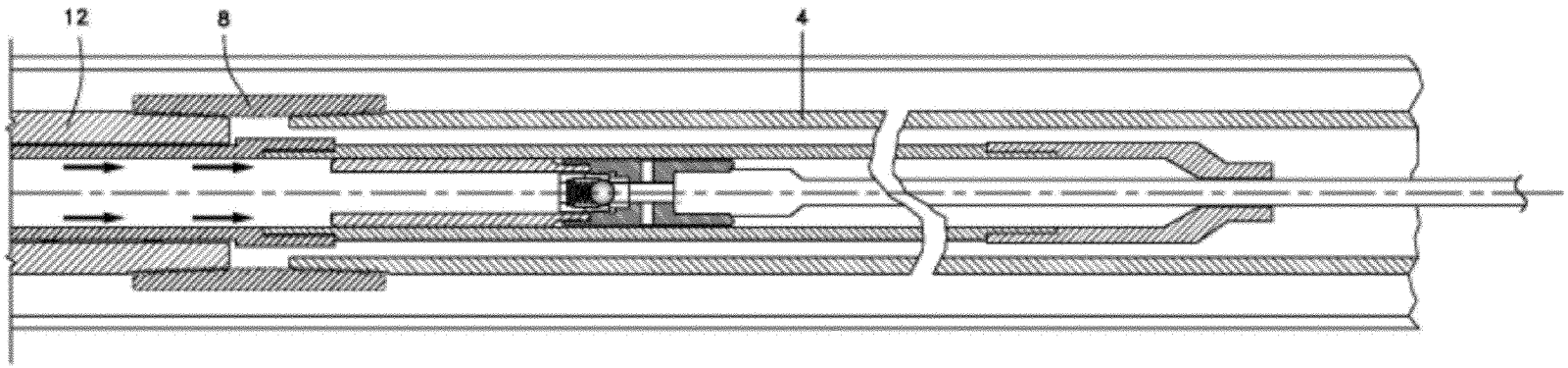
Figure 8B:
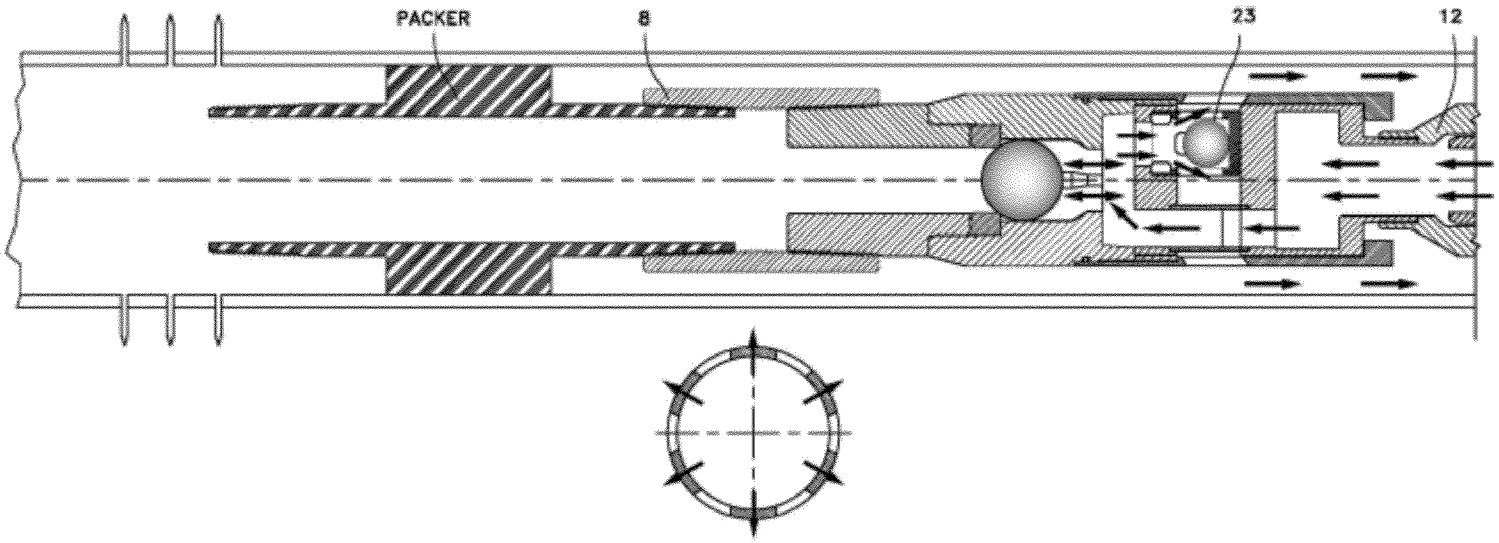
In FIG. 8*b* the enlarged detail exemplifies the production area.
Figure 8B:
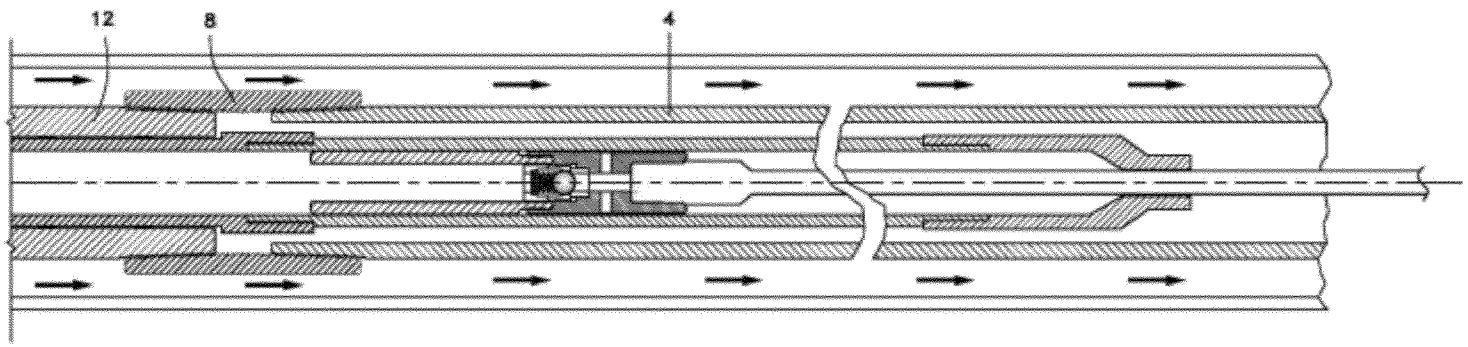

REFERENCES: In the Figures previously described, references have been incorporated in order to identify the several components. The same references included in different figures identify the same components.

Reference number -1- indicates a piston; number -2- a barrel; number -3- the casing; number -4- the tubing; number -5- a stem; number -6- a guide; number -7- a relief valve; number -8- a torque; number -9- a conduit; number -10- a cage; number -11- an anchor; number -12- a nipple; number -13- a transfer box; number -14- a connector; number -15- a basket; number -16- a ball; number -17- a seat; number -18- a carrier body; number -19- a little ball; number -20- a seal; number -21- connector body; number -22- a window; number -23- a bolt; number -24- an opening, and number -25- an outer piece. The arrows added to the different figures show the direction and traveling of the fluid.

The invention herein revealed is a deep force pump for oil wells and comprises a piston which allows the entrance of fluid to the bomb in its upward stroke, whereas in its downward stroke, it expels the fluid towards a route which produces through the tubing, or towards a route that produces through the casing.

The route can be selected by the user on the basis of measurements and observations that lead him to determine whichever route is in better conditions.

In the following paragraphs, a version of the invention is explained in order to establish its nature and then complement it with a description of the functional and operative relationship of its components and the result provided.

The versatility of the invention proposed in this documentation allows the user to adapt to the characteristics of each well, so therefore it will be he who, according to his own observations and measurements, will be able to determine if he uses the tubing or the casing to extract the fluid and take it to the surface, selecting the route that is in better conditions at the moment of carrying out the procedure.

Once the production route to be used has been selected, the lower part of the pump is descended together with the tubing down to the appropriate depth for the well exploitation.

Then the barrel and the piston are descended by means of the rods in order to connect them to said lower part using an appropriate mechanism.

For the pumping of fluid towards the surface, the pump proposed in this documentation works in a reverse manner to those pumps detailed in the prior art, which means that when the piston -1- of the pump rises, it allows the admission of the fluid in the barrel -2- and when the piston descends the fluid is ejected towards the casing -3- or towards the tubing -4- according to the production route previously selected.

The pump being described provides a stem -5- which upper end is linked to a number of load rods which are followed by a number of standard rods until the necessary height is achieved in order to reach the pumping unit located on the surface.

The load rods are ballasted rods with a weight which amount is calculated according to the depth of the operation, the fluid viscosity, the piston (1) area and the section of the production route.

The weight of said load rods permits to reduce the work to move the piston (1) during the downward movement and, since the weight of the hydrostatic column is not applied onto the piston (1), the work necessary to move this piston upwardly will only require moving the weight of said load rods. This will result in much lesser weight than the hydrostatic pump weight; unlike the pumps in the prior art which in their upward stroke lift the rods plus the weight of the fluid (hydrostatic column).

The stem (5) travels inside a guide -6- which upper end diameter is adjusted to the diameter of the stem (5) and then increases connecting itself to the barrel (2).

The excess of pressure that can be generated between the lower end of the guide (6) and the upper end of the piston (1) is controlled by a relief valve -7- which is housed inside the piston cage (1). Therefore, once the tension of the calibrated spring provided in said valve is surpassed, the displacement of the valve ball is achieved so as to equalize pressures.

As the piston is hollow, the opening of the relief valve (7) determines the passage of the exceeding pressure towards the inside of the piston.

A threaded portion for a torque -8- is provided in the lower end of the tubing (4). Such torque (8) is fixed to the upper end of a conduit -9- which diameter increases to comprise the components arranged between the cage 10- and the nipple -12- which lower end is linked to the transfer box -13-.

At the same time, the upper part of the anchor -11- is linked to the lower end of the barrel (2) by means of a thread; while the lower part is linked to said nipple (12) that, as previously said, is fixed to the transfer box (13).

Said nipple (12) guarantees the airtightness of a lower chamber comprised by the added volumes of the hollow portion of the piston (1), the barrel (2), the anchor (11), the nipple (12) and the transfer box (13).

In order to achieve the fluid to go through both directions as a consequence of the upward and downward movement of the piston (1), at least one connector -14- is provided between the basket -15- and the transfer box (13), so as to transfer the fluid from the admission valve towards the barrel (2) during the upward stroke and the emptying of the barrel (2) in the downward stroke.

Said basket (15) is arranged immediately below the transfer box (13) and it constitutes the ball housing -16- and the seat -17- of at least one production valve, which, together with at least one connector (14), is arranged in a carrier body -18- connected to the conduit (9) in such a manner that said carrier body (18) is retained between said transfer box (13) on the top side and the cage (10) on the bottom side.

The admission valve is housed inside said cage (10) and it is provided with a ball -19- that releases or obstructs the passage of the fluid.

Said passage provides a seal -20- where the ball (19) is seated. Said ball is connected to a connector body -21- that enables the adjustment of the admission valve and which has a threaded portion in its lower end to which a torque (8) is fixed.

The basket (15) is provided with a number of windows -22- which are the openings that permit the passage of the fluid coming out.

A number of bolts -23- is provided in order to fix the carrier body (18) to the transfer box (13) and also to adjust the basket (15) and at least one connector (14) sealing them.

We can so far summarize by saying that the piston (1) in its upward stroke creates a vacuum chamber developed between its lower end and the admission valve. The negative pressure operates the opening of the admission valve and consequently the passage of the fluid.

The production valves remain closed in this stroke, on one hand due to the hydrostatic column weight present inside the tubing (4) that works directly onto them, and on the other hand as a consequence of the depression created by the piston (1).

As the admission valve opens due to the higher outside pressure, the fluid coming from the well enters, goes through the connectors (14) and the transfer box (13) to get inside the barrel (2).

Piston (1) in its downward stroke, assisted by the weight of the load rods, moves the fluid accumulated inside the barrel (2) towards the transfer box (13) and by means of the connectors (14) towards the cage (10) of the admission valve.

The pressure created by the piston (1) produces the closing of the admission valve and makes the internal pressure increase until it exceeds the pressure created by the fluid weight inside the tubing (4) and causes the production valves to open, starting in this manner the productive cycle of the well.

The other option for the user is to make use of the casing (3) as a production route and for this purpose only minimal changes are required.

According to the previous description this invention includes a conduit (9) which shape similar to a bottle permits to carry out a derivation in order to get the passage of the fluid towards the tubing (4).

In order to achieve the derivation to the casing (3) the passage is carried out from a number of openings -24- arranged in an external piece -25- that adjusts onto the transfer box (13) so said windows open to let the fluid pass during the downward stroke of the piston (1).

In the production by casing (3) and as we have already seen in the production by tubing (4), during the upward stroke the piston (1) creates a vacuum chamber that develops between its lower end and the admission valve.

During this stroke, the production valves remain closed as a consequence of the weight of the hydrostatic column and the depression produced by the piston (1).

Once the admission valve is open, this enables the intake of the fluid coming from the well, through the inside of the packer and by the connectors (14) and the transfer box (13) towards the inside of the barrel (2).

The piston (1) in its downward stroke, assisted by the weight of the load rods, moves the fluid accumulated inside the barrel (2) towards the transfer box (13) and the connectors (14) towards the cage (10) of the admission valve, causing the valve to close. The internal pressure increases until it exceeds the hydrostatic pressure of the casing (3), creating the immediate opening of the production valves thus starting the productive cycle of the well.

In this route of production, the packer is separating two fields. One of them, located below the packer, is called of generation, that is to say the one where the fluid to be taken is.

The field called producer is located above said piece and isolated from the generator field. This producer field is the one integrated with the fluid extracted from the generator field that has entered in the pump and has been ejected to accumulate between the external wall of the tubing (4) and the internal wall of the casing (3).

According to what has been previously stated it emerges that the pump being revealed works in a reverse manner to the way as a cylinder of an internal combustion engine does, therefore, when the piston (1) rises it permits the passage of fluid, filling the lower chamber and when it descends it ejects it.

In fact, the piston (1) in its upward stroke produces a depression that brings about the opening of the admission valve thus allowing the admission of the well fluid until the chamber is filled whereas in its downward stroke the piston (1) pushes the fluid, ejecting it in an amount that results equivalent to the volume of said chamber. This volume starts accumulating in a column that obviously becomes higher (and heavier) with each pumping.

In order to make its downward stroke easier, the piston (1) is assisted by the load rods located immediately above the same so as to avoid the crushing or compression of the rods.

The weight of said rods has been previously calculated with the purpose to determine the load that the piston (1) needs to be able to surpass the weight of the hydrostatic column and to allow the opening of at least one production valve.

The amount of production valves added in the pump varies according to the well requirements as well as to the needs of the area. If the exploitation requires more than one of these valves, said valves are first placed in the central area and in case they are several, they are distributed in a ring-shaped manner.

When the weight can surpass the pressure exercised by the column, the production valve or valves open, and let the fluid travel from the inside of the chamber towards the production area.

In a traditional system, during the upward stroke, the pumping unit must lift both the weight of the pumping rods and the fluid weight from the extraction level up to the wellhead.

In the invention being described, the pumping unit in the upward stroke lifts only the weight of the pumping rods, increased with the weight of the load bars which is sensibly lower to the weight of both the pumping rods and the fluid column.

In this manner, when lifting a lower weight, the size of the several mechanisms used is reduced and, consequently, the energy consumption and the efforts of the mechanical pumping unit are reduced too.

In the description, there is reference to the use of torques (8) normally called "sacrifice torques" which, although they are not part of this invention, absorb the torque that the equipment being used could transmit to the pump to make it descend.

The connector body (21) is a fundamental part in this invention since it permits to connect several components. For this purpose it is provided with a thread in its lower part to connect it with the torque (8), a thread in its external part to connect it with the conduit (9), a third thread located in its upper part to connect it with the body which houses the admission valve of the fluid and a last thread in the internal part of its upper end to relate it with the carrier body (18) which houses the production valve or valves and the connector or connectors (14) that permit the travel of the fluid that has entered from the well to the barrel (2).

The windows (22) provide a very large space in order to achieve a correct passage of fluid avoiding the accumulation of solid waste in the cage (10) where the valves are housed.

Likewise, and in order to improve the operative travelling, a clearance is left between the surface of the pump and the walls of the casing (3).

The connector body (21) houses the carrier body (18) inside, which provides at least a housing space for a cage (10) provided with at least one production valve which permits the passage of fluid previously entered from the admission valve towards the windows (22). The production valve or valves open when the internal pressure created by the downward stroke of the piston (1) exceeds the hydrostatic pressure of the fluid column.

In this manner, one of the possible embodiments to carry out this invention has been detailed, as well as the manner in which the same works, complementing this documentation with the synthesis of the invention contained in the claims hereinafter stated.

Having described and determined the nature, scope and manner in which this invention can be put into practice in its fundamental idea, it is declared as invention and of exclusive property the following:

1. A deep force pump for oil wells comprising:

a piston and a stem linked to a pump arranged on a surface by a number of rods, a production route established between a casing and a tubing, the stem travels inside a guide, the guide has an upper end having a diameter which increases towards a barrel, an anchor including an upper end is connected to a lower end of said barrel and a lower end of said anchor is connected to a nipple fixed to a transfer box, a basket located below the transfer box, in an upward stroke of the piston the fluid passes from an admission valve to the barrel, and in a downward stroke of the piston the barrel is emptied, at least one connector connected between the basket and the transfer box, the basket houses a ball and a seat of a production valve, the production valve and one of the connectors are arranged in a carrier body, the carrier body is retained between said transfer box and a cage and fitted to a conduit, the admission valve is located inside the cage and has a ball that releases or obstructs the passage of the fluid, the passage provides a seating seal for said ball, the ball is linked to a connecting body that tightens the admission valve which provides a threaded torque in its lower end, and a relief valve is housed in the piston cage, the opening of said relief valve releases excess pressure generated between the lower end of the guide and the upper end of the piston towards the inside of the piston.

2. The pump, as in claim 1, wherein the basket provides a number of windows constituting the passages for the fluid to get out.

3. The pump, as in claim 1, wherein the carrier body is fixed to the transfer box with a number of bolts which simultaneously tighten the basket, and at least one connector, sealing them.

4. The pump, as in claim 1, wherein during the upward stroke the piston creates a vacuum chamber and a negative pressure which operates the opening of the admission valve and the passage of fluid together with the weight of the hydrostatic column of the inside of the tubing that keeps the production valves closed.

5. The pump, as in claim 1, wherein during the downward stroke, the piston is helped by the weight of the load bars, moves the fluid from the interior of the barrel to the transfer box and through the connectors to the cage of the admission valve opening, due to the increase of the exterior pressure, gives way to the fluid coming from the well through the connectors and the transfer box to the interior of the barrel.

6. The pump, as in claim 1 wherein the pressure generated by the piston closes the admission valve, increasing internal pressure until said internal pressure gets past the pressure of the fluid weight inside the tubing, wherein the production valves are opened.

7. The pump, as in claim 1, wherein the production valves are placed in a central area and distributed in a ring-shaped manner.

8. The pump, as in claim 1, wherein during the upward stroke, the pumping unit lifts the weight of the pumping rods.

9. The pump, as in claim 1, wherein the connector body is linked by the lower part with the torque, by the external part with the conduit, by the upper part with the housing body of the admission valve of the fluid and by the internal part of the upper end with the carrier body which houses the at least one production valve and the at least one connector.

10. The pump, as in claim 1, wherein the number of load rods continues with a number of standard rods in a sufficient amount so that a total length reaches the pumping unit placed on the surface and where a total weight of said number of rods is calculated in function of an operation depth, a fluid viscosity, a piston area and a section of the production route.

11. The pump, as in claim 1 wherein the nipple guarantees the airtightness of a lower chamber comprised by an added volume of a hollow portion of the piston, the barrel, the anchor, the nipple and the transfer box.

12. The pump, as in claim 1, wherein a lower end of the tubing provides a threaded portion for a torque fixed to a conduit in which a diameter increases to accommodate components disposed between the cage and the nipple and which the lower end is linked to the transfer box.

13. The pump, as in claim 1, wherein once the production route has been selected for the casing, the passage of fluid is performed from a number of openings that open during the downward stroke of the piston a, in during said upward stroke a vacuum chamber is created between a lower end and the admission valve, during which the production valves remain closed; the opening of said admission valve allowing the entrance of the fluid coming from the well through the inside packer and at least from a connector and the transfer box towards the inside of the barrel, and the piston during a downward stroke moving the fluid accumulated inside the barrel towards the transfer box and the connectors up to the cage of the admission valve, closing it and increasing the internal pressure to exceed the hydrostatic pressure of the casing, thereby operating the opening of the production valves.

14. The pump, as in claim 13, wherein the packer separates two fields where a field below is the one from where the fluid is to be removed, and an upper field is the one where the removed fluid is, which has entered in the pump and was expelled to get accumulated between an external wall of the tubing and the internal wall of the casing.

15. The pump, as in claim 13 wherein a clearance is left between a surface of the pump and the walls of the casing.

* * * * *